US007090093B2

(12) United States Patent
Hochrainer et al.

(10) Patent No.: US 7,090,093 B2
(45) **Date of Patent: *Aug. 15, 2006**

(54) PRESSURE COMPENSATION DEVICE FOR A TWO-PART CONTAINER

(75) Inventors: Dieter Hochrainer, Bingen (DE); Bernd Zierenberg, Bingen (DE); Heinrich Kladders, Muelheim (DE); Martin Essing, Bocholt (DE); Gilbert Wuttke, Dortmund (DE); Matthias Hausmann, Dortmund (DE); Joachim Eicher, Dortmund (DE)

(73) Assignee: Boehringer Ingelheim International GmbH, Ingelheim (DE)

( * ) Notice: Subject to any disclaimer, the term of this patent is extended or adjusted under 35 U.S.C. 154(b) by 316 days.

This patent is subject to a terminal disclaimer.

(21) Appl. No.: 10/815,531

(22) Filed: Apr. 1, 2004

(65) Prior Publication Data

US 2004/0182867 A1 Sep. 23, 2004

Related U.S. Application Data

(63) Continuation of application No. 09/831,054, filed on Jul. 27, 2001, now abandoned, which is a continuation of application No. 09/437,275, filed as application No. PCT/EP99/08542 on Nov. 8, 1999, now Pat. No. 6,223,933.

(30) Foreign Application Priority Data

Nov. 7, 1999 (DE) ..... 198 51 404

(51) Int. Cl.
*B67D 5/42* (2006.01)
*B65D 1/32* (2006.01)

(52) U.S. Cl. ..... 220/723; 222/386.5

(58) Field of Classification Search ..... 206/527–528; 220/495.01, 495.06; 222/95, 105, 107, 386.5, 222/389

See application file for complete search history.

(56) References Cited

U.S. PATENT DOCUMENTS

| | | | | |
|---|---|---|---|---|
| 440,316 | A | | 11/1890 | Long |
| 2,669,370 | A | | 2/1954 | Royall, Jr. |
| 3,193,993 | A | | 7/1965 | Barton et al. |
| 3,255,972 | A | | 6/1966 | Hultgren et al. |
| 3,828,977 | A | * | 8/1974 | Borchert ..... 222/95 |
| 3,878,977 | A | | 4/1975 | Carlisle |
| 4,008,820 | A | | 2/1977 | Ruetz |
| 4,045,860 | A | | 9/1977 | Winckler |
| 4,162,030 | A | * | 7/1979 | Capra et al. ..... 222/95 |
| 4,187,893 | A | | 2/1980 | Bujan |
| 4,202,470 | A | * | 5/1980 | Fujii ..... 222/386.5 |
| 4,264,018 | A | | 4/1981 | Warren |
| 4,322,020 | A | | 3/1982 | Stone |
| 4,440,316 | A | | 4/1984 | Christine |
| 4,457,454 | A | | 7/1984 | Meshberg |
| 4,457,455 | A | | 7/1984 | Meshberg |
| 4,469,250 | A | | 9/1984 | Evezich |
| 4,479,989 | A | | 10/1984 | Mahal |
| 4,732,299 | A | | 3/1988 | Hoyt |
| 4,817,830 | A | | 4/1989 | Yavorsky |
| 4,886,177 | A | | 12/1989 | Foster |
| 5,004,123 | A | | 4/1991 | Stoody |
| 5,031,384 | A | | 7/1991 | Rebeyroll et al. |
| 5,038,958 | A | | 8/1991 | Dreier |
| 5,102,010 | A | | 4/1992 | Osgar et al. |
| 5,105,995 | A | | 4/1992 | Martin |
| 5,158,810 | A | | 10/1992 | Oishi et al. |
| 5,176,178 | A | | 1/1993 | Schurter et al. |
| 5,242,085 | A | | 9/1993 | Richter et al. |
| 5,289,818 | A | | 3/1994 | Citterio et al. |
| 5,316,221 | A | | 5/1994 | Glover et al. |
| 5,325,977 | A | | 7/1994 | Haynes et al. |
| 5,332,121 | A | | 7/1994 | Schmidt et al. |
| 5,355,872 | A | | 10/1994 | Riggs et al. |
| 5,385,251 | A | | 1/1995 | Dunn |
| 5,395,365 | A | | 3/1995 | Weiler et al. |
| 5,433,347 | A | * | 7/1995 | Richter et al. ..... 222/105 |
| 5,480,067 | A | | 1/1996 | Sedlmeirer |
| 5,497,909 | A | | 3/1996 | Wirsig et al. |
| 5,509,564 | A | | 4/1996 | Knoop |

| | | | | | |
|---|---|---|---|---|---|
| 5,509,578 | A | | 4/1996 | Livingstone | |
| 5,514,123 | A | | 5/1996 | Adolf et al. | |
| 5,520,975 | A | | 5/1996 | Inoue et al. | |
| 5,579,760 | A | | 12/1996 | Kohler | |
| 5,642,838 | A | | 7/1997 | Stoody | |
| 5,752,629 | A | | 5/1998 | Hardy | |
| 5,772,080 | A | | 6/1998 | de Pous et al. | |
| 5,813,570 | A | | 9/1998 | Fuchs et al. | |
| 5,839,623 | A | * | 11/1998 | Losenno et al. | 222/386.5 |
| 5,873,491 | A | | 2/1999 | Garcia et al. | |
| 5,875,936 | A | | 3/1999 | Turbett et al. | |
| 5,878,915 | A | | 3/1999 | Gordon et al. | |
| 5,893,484 | A | | 4/1999 | Fuchs et al. | |
| 5,894,841 | A | | 4/1999 | Voges | |
| 5,910,138 | A | | 6/1999 | Sperko et al. | |
| 5,944,217 | A | | 8/1999 | Baena | |
| 6,062,213 | A | | 5/2000 | Fuisz et al. | |
| 6,116,466 | A | * | 9/2000 | Gueret | 222/386.5 |
| 6,129,236 | A | | 10/2000 | Osokin et al. | |
| 6,244,472 | B1 | | 6/2001 | Hennemann | |

FOREIGN PATENT DOCUMENTS

| | | | |
|---|---|---|---|
| DE | 3446697 | | 6/1986 |
| EP | 0 114 964 | A1 | 8/1984 |
| EP | 0169501 | | 1/1986 |
| EP | 0 182 094 | A2 | 5/1986 |
| EP | 0 217 425 | A1 | 4/1987 |
| EP | 0 315 440 | B1 | 5/1989 |
| EP | 0322980 | | 7/1989 |
| EP | 0 368 112 | | 5/1990 |
| EP | 0 368 112 | A2 | 5/1990 |
| EP | 0 495 330 | A1 | 7/1992 |
| EP | 0 532 873 | A1 | 3/1993 |
| EP | 0 622 311 | | 2/1994 |
| EP | 0 585 908 | A2 | 3/1994 |
| EP | 0 620 165 | A1 | 10/1994 |
| EP | 0 621 027 | A1 | 10/1994 |
| EP | 0635254 | | 1/1995 |
| EP | 0653359 | | 5/1995 |
| EP | 0654419 | | 5/1995 |
| EP | 0 661 218 | | 7/1995 |
| EP | 0763482 | | 3/1997 |
| EP | 0 812 625 | | 12/1997 |
| EP | 0 812 625 | A2 | 12/1997 |
| FR | 1 159 909 | | 7/1958 |
| FR | 2 762 589 | | 10/1998 |
| JP | 09225356 | A | 9/1997 |
| WO | WO 90/06267 | | 6/1990 |
| WO | WO 91/14468 | | 10/1991 |
| WO | WO92/16439 | | 10/1992 |
| WO | WO 93/23165 | | 11/1993 |
| WO | WO 95/15895 | | 6/1995 |
| WO | WO 96/03218 | | 2/1996 |
| WO | WO 97/06842 | | 2/1997 |
| WO | WO 97/12687 | | 4/1997 |
| WO | WO97/18143 | | 5/1997 |
| WO | WO 97/26998 | | 7/1997 |
| WO | WO99/43571 | | 9/1999 |
| WO | WO 00/27543 | | 5/2000 |
| WO | WO 00/49988 | | 8/2000 |

* cited by examiner

*Primary Examiner*—Luan K. Bui
(74) *Attorney, Agent, or Firm*—Michael P. Morris; Thomas C. Blankinship; Timothy X. Witkowski

(57) ABSTRACT

For medical fluids, two-part containers are used which consist of an inner container and an outer container which is impenetrable to diffusion. The inner container collapses when the fluid is removed. For the purposes of pressure compensation between the gaseous space, disposed between the inner- and outer containers, and the surroundings of the two-part container, a pressure compensation device is required by means of which at the same time the loss of fluid through diffusion from the collapsible inner container is kept as little as possible. To that end, at least one channel is used which communicates the gas-filled intermediate space with the surroundings of the two-part container. The time constant for compensation of a pressure differential of a few millibars is within the region of quite a few hours. It is obtained by selecting the length of the channel and channel cross-section. The, at least one, channel can be produced individually, or a plurality of channels can be present in the form of pores in an open-pore sintered material or in a permeable membrane. The pressure compensation device permits storage of the two-part container for many years, and use for many weeks as fluid is being removed in portion-wise manner. During these times, the quantity of fluid in the inner container, or the concentration thereof changes substantially less than with the use of a known two-part container.

17 Claims, 5 Drawing Sheets

PRESSURE COMPENSATION DEVICE FOR A TWO-PART CONTAINER

Figure 1A:
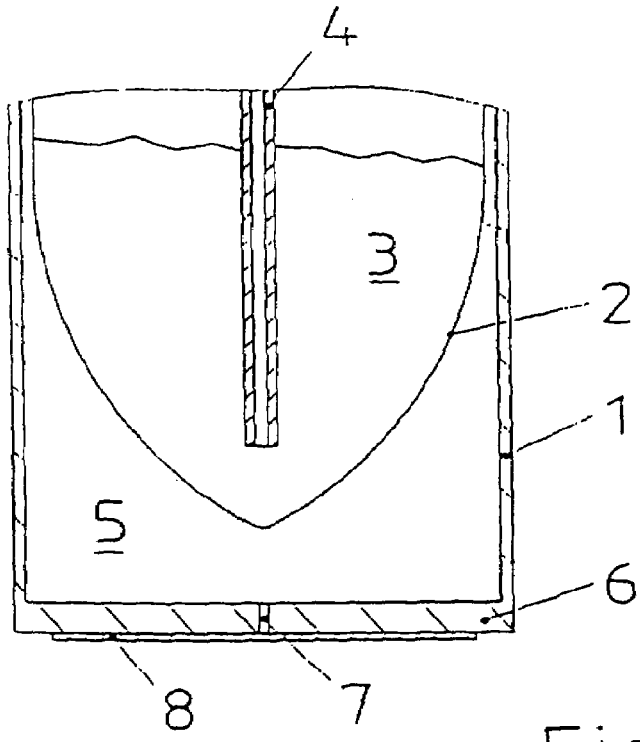

This application is a continuation of Ser. No. 09/437,275, filed on Nov. 10, 1999, U.S. Pat. No. 6,223,933 and which is a continuation of Ser. No. 09/831,054, filed on Jul. 27, 2001, abandoned which is a 371 of PCT/EP99/08542 filed on Nov. 8, 1999.

The invention relates to a pressure compensation two-part container which consists of a rigid outer container and a collapsible inner container. The inner container contains a fluid.

The aim of the invention is to disclose a device which is suitable for the compensation of pressure between the ambient air and the gaseous space between the inner container and the outer container, and which can be produced economically and which is protected from blockages.

The keeping of fluids, possibly containing a medicine, in a flexible inner container disposed inside a rigid outer container prior to use is known. When fluid is removed from the inner container by means of a metering pump, the inner container collapses. If the outer container does not contain an opening, a reduced pressure builds up in the closed intermediate space between the two containers. When a metering pump is used, which can only produce a small intake pressure, removal of fluid becomes difficult as soon as the reduced pressure between the two containers has become approximately equal to the intake pressure. It is then necessary to produce pressure compensation in the intermediate space between the two containers.

DE-41 39 555 describes a container which consists of a rigid outer container and an easily deformable inner bag. The container is produced in a co-extrusion-blowing process from two thermoplastics synthetic materials which merge together without a join. The outer container has a closed bottom and contains at least one opening for the compensation of pressure between the surroundings and the space between the outer container and the inner bag. The shoulder section of the outer container has at least one unwelded seam between two oppositely disposed wall sections of the outer container which are not welded together. Preferably, two unwelded seams are provided in the shoulder region of the outer container. The inner bag is sealingly closed in this region by weld seams. By virtue of the unwelded seam sections in the shoulder region of the outer container air is able to enter the intermediate space between the outer container and the inner bag. The edges which are not welded together at the open seam in the shoulder region of the outer container tend to rest against each other when reduced pressure prevails. Therefore, a further proposal has been made to provide preferably a plurality of holes in the upper region of the wall of the outer container to act as ventilation openings which may be produced by ultrasound or mechanically by perforating the outer container, for example. All openings in the wall of the outer container in the shoulder region and upper wall region are covered by means of the housing of the pump which is placed on the container.

The two-part containers according to the prior art contain open seams or holes in the outer container. The outer container consists, without exception, of a thermoplastics synthetic material.

Should the flexible inner container not be completely impenetrable to diffusion and the fluid in the inner container be volatile or contain volatile components, then fluid is lost from the inner container by diffusion, or the composition of the fluid is changed in a way which is perhaps inadmissible. This effect is promoted by air no longer flowing into the intermediate space between the outer container and the inner container over a long period of time after pressure compensation has ended, and by the pressure compensation openings in the outer container having a cross-section like the known two-part containers.

Therefore the problem is posed of disclosing a device for a two-part container which is suitable for the compensation of pressure between the ambient air and the gas space between the inner container and the outer container, even if the inner container contains a fluid which is volatile or which contains a volatile component with respect to which the inner container is impenetrable to diffusion to a limited extent. Even when the filled two-part container is in storage for many years and when the two-part container undergoes prescriptive use for many months, the quantity of fluid in the inner container or the concentration of fluid components should only change to an extent which is substantially less than when the known two-part container is used.

This problem is solved according to the invention by way of a pressure compensation device for a two-part container which consists of an outer container and an inner container. The inner container contains an, at least partially volatile, fluid. The two-part container is disposed in gas-filled surroundings. The pressure-compensation device is characterised by the following features:

- The inner container is impenetrable to diffusion to a limited extent vis-à-vis the at least partially volatile fluid, and is collapsible. The outer container is impenetrable to diffusion and rigid.
- The outer container is sealingly connected to the inner container.
- A gas-filled intermediate space is present between the two containers.
- At least one channel communicates the gas-filled intermediate space between the outer container and the inner container with the surroundings of the two-part container.
- The, at least one, channel has a cross-sectional surface area with an equivalent diameter of between 10 μm and 500 μm.
- The, at least one, channel is between five thousand times and one tenth of a time as long as the equivalent diameter of the, at least one, channel.

The equivalent diameter of the, at least one channel, is the diameter of a circle, the surface area of which is equal to the cross-sectional surface area of the, at least one, channel. The, at least one, channel can preferably be between one hundred times and one tenth of a time, particularly preferably between ten times and once, as long as the equivalent diameter of the, at least one, channel.

The cross-section of the channel is preferably as wide as tall, that is to say is preferably a round or approximately square cross-section or triangular cross-section. Furthermore, the cross-section of the channel can be rectangular, trapezoidal, semi-circular, slot-like, or of irregular shape. The ratio of the length of the sides of a slot-like channel can be up to 50:1. A plurality of channels can be arranged uniformly, e.g. at the points of intersection of a grid, or non-uniformly, e.g. statistically distributed. The cross-sectional surface area of the channel is less than 1 $mm^2$ and can extend into the range of a few thousand square micrometers.

The channel can be straight or curved, or be shaped in the form of a meander, spiral or screw. The channel can be arranged, preferably in the form of a bore, in the wall of the outer container. Furthermore, the channel can be arranged in an insert which preferably consists of plastics material, the insert being sealingly arranged on the wall of the outer container, preferably in an inwardly inverted recess in the bottom of the outer container. In this case, the end of the channel which faces the intermediate space communicates with an opening in the wall of the outer container. That opening is of greater cross-section than the channel.

A gas-permeable filter, e.g. a fibre fleece or a body of open-pore sintered material, can be arranged to act as a dust protector at the one end of the channel, preferably at the end facing the surroundings.

The end of the channel facing the surroundings can be closed by means of a sealing foil whilst the two-part container filled with a fluid is being stored, the sealing foil being torn partially or completely away from the inner container, or being pierced, when fluid is removed for the first time.

The wall of the, at least one, channel, can be smooth or rough.

The, at least one, channel can be produced in the form of a micro-bore in a plate, e.g. by means of a laser beam. A meander-like or spiral channel can be produced by selective cauterization of a silicium surface, for example; a channel of this kind can be of triangular or trapezoidal cross-section. Furthermore, a channel of triangular cross-section and almost any shape can be obtained by moulding a (metal) surface. A helical channel can be arranged on the lateral surface of a cylinder projecting into a pipe. Also, a channel of this kind can be arranged on the lateral surface of a hollow cylinder in which a cylindrical body is placed. Almost any shape of channel can be produced by lithography and moulding in plastics material or metal.

The half-value times and one tenth-value times of the pressure compensation with a pressure differential of less than 20 hPa (20 mbar) between the surroundings and the gaseous space with a volume of 3 millilitres are given for channels of circular cross-section, different lengths and different diameters in the following table, by way of example:

| Channel | | | One Tenth-Value |
|---|---|---|---|
| Length mm | Diameter µm | Half-Value Times Hours | Times Hours |
| 0.2 | 80 | 1.8 | 5.8 |
| 0.2 | 70 | 3.3 | 10.6 |
| 0.2 | 60 | 6.4 | 21.0 |
| 0.2 | 50 | 13.5 | |
| 0.2 | 50 | 13.5 | |
| 1 | 75 | 13.5 | |
| 10 | 133 | 13.5 | |
| 100 | 236 | 13.5 | |

Instead of the one channel a plurality of channels of this kind can be provided, or a plate of porous material with open pores, e.g. an open-pore sintered material, can be provided. The pores have a mean pore diameter of between 0.1 and 150 µm. The pore volume is between 1% and 40% of the volume of the sintered body. The sintered body can consist of plastics material, e.g. polyethylene, polypropylene, polyvinylidene fluoride, or glass, quartz, ceramics, or metal. The plate thickness can preferably be between 1 and 5 mm. The plate which is preferably round can preferably be sealingly inserted into a recess in the bottom of the outer container, e.g. pressed in or glued in place.

Furthermore, a permeable membrane containing a plurality of channels of this kind can be used in the form of a foil, woven cloth, or fleece, which can consist of a thermoplastics material—such as polytetrafluor ethylene or polyether ether ketone—or an elastomer plastics material—such as silicone or latex. Permeable membranes in the form of a woven fabric or fleece can consist of natural fibres, inorganic fibres, glass fibres, carbon fibres, metal fibres, or synthetic fibres. Also, a permeable membrane in the form of a metal foil—like gold, silicium, nickel, special steel—or glass or ceramics, can be used.

The channels in permeable membranes of this kind can be arranged in non-uniform manner and may be produced by ion bombardment or by plasma-cauterization. In addition, the channels can, be arranged in uniform manner and be produced by lithography and moulding or laser drilling; in this case, the many channels can be present within narrow tolerances inside the permeable membrane in accordance with the shape and size of the channel cross-section and in accordance with the channel length.

The outer container which is impenetrable to diffusion preferably consists of a rigid material, e.g. metal. An outer container of this kind facilitates storage and handling of the two-part container and protects the inner container from mechanical effects externally.

The pressure compensation device according to the invention is used with a two-part container, for example, which serves to receive a medical fluid which may contain a medicine dissolved in a solvent. Suitable solvents are water, ethanol or mixtures thereof, for example. The medicines used may be Berotec (fenoterol-hydrobromide; 1-(3,5-dihydroxy-phenyl)-2-[[1-(4-hydroxy-benzyl)-ethyl]-amino]-ethanol-hydrobromide), Atrovent (ipratropium bromide), Berodual (combination of fenoterol-hydrobromide and ipratropium bromide), Salbutamol (or Albuterol), Combivent, Oxivent (oxitropium-bromide), Ba 679 (tiotropium bromide), BEA 2108 (Di-(2-thienly) glycolic acid tropenol ester), Flunisolid, Budesonid, and others.

The pressure compensation device according to the invention has the following advantages:

- It does not contain any movable parts and is a static device.
- The gas permeability is adjustable, even with the use of a permeable membrane or a sintered plate.
- It permits pressure compensation beginning immediately for each pressure differential.
- Compensation of a pressure differential is gradual. With prescriptive use, the time constant and therefore the duration of the pressure compensation can be adapted to the temporal passage of metered removal of fluid from the inner container.
- It can be used for outer containers of any material which are impenetrable to diffusion. The outer container can consist of a rigid material—like metal or plastics material—or a yielding material.
- It does not permit any accidental intervention in the gaseous space between the outer-and inner containers, and protects the collapsible inner container.
- After the compensation time, the pressure differential is virtually zero.
- It produces a defined communication between the gaseous space and the ambient air.
- It is permeable to gas when the sealing foil has been removed, and permits the passage of gas in both directions.
- It does not require any intervention from outside and no foreign force and is continuously effective.
- A volatile substance which diffuses from the fluid which is present in the inner container, through the wall of the inner container, into the intermediate space between the inner container and outer container escapes from the intermediate space primarily by diffusion through the, at least one, channel. Therefore, even with long-term use of the fluid in the inner container, only an extremely small proportion of a volatile substance is lost from the fluid in the inner container. This loss is substantially less than with known two-part containers.

The two-part container containing a fluid in the inner container can be stored for many months without any significant loss of the substance, even when the impenetrability to diffusion of the inner container is limited, and can be used for many months.

It can be produced in large numbers economically.

The pressure compensation device according to the invention is used with a two-part container, for example, which may contain the liquid for atomisation in the atomiser described in WO-97/12687.

The device according to the invention will be described in greater detail with the aid of the drawings given by way of example.

FIG. 1*a* shows a section through the two-part container, before fluid is removed for the first time. The outer container (1) contains the collapsible inner container (2) which is filled with a fluid (3). The removal connection piece (4) projects into the fluid. The inner container is connected to the outer container in seal-tight manner at its end (not shown). Disposed between the two containers is the gaseous space (5). Arranged in the bottom (6) of the outer container is the straight channel (7) which connects the gaseous space (5) to the surroundings outside the two-part container. This channel is covered over by the sealing foil (8).

Figure 1B:
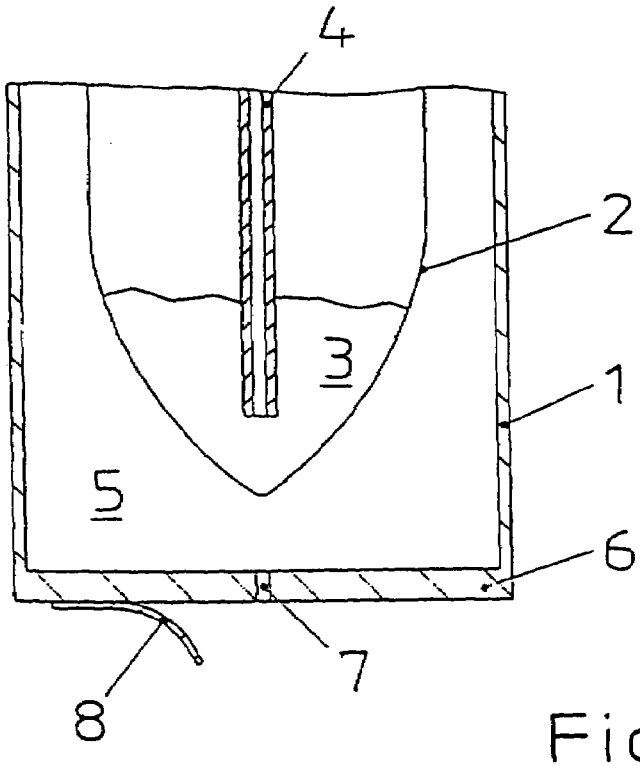

FIG. 1*b* shows a section through the two-part container after part of the fluid has been removed from the inner container. The sealing foil (8) is shown partly torn away, and the inner container is shown in a partly collapsed state.

Figure 2:
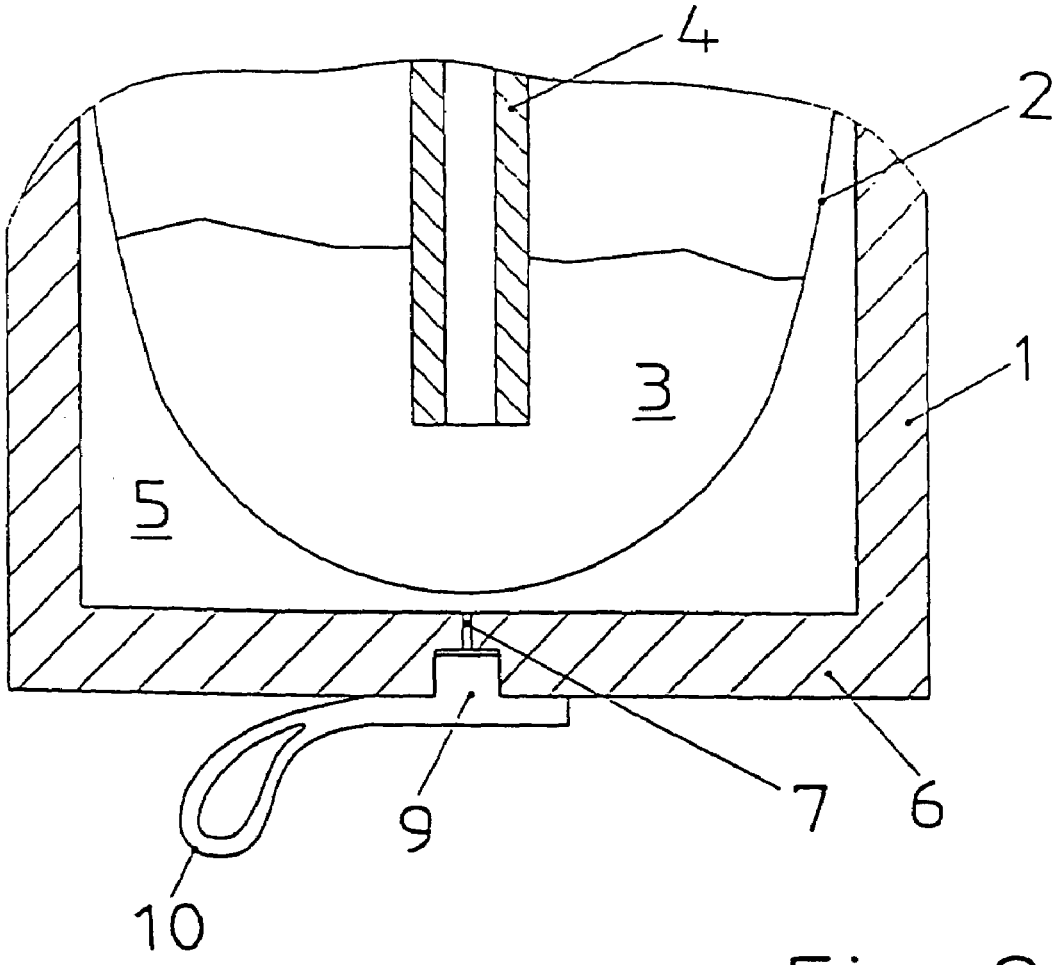

FIG. 2 shows a section through another embodiment of two-part container before fluid is removed from the inner container for the first time. The straight channel (7) is closed in seal-tight manner at the end thereof facing the surroundings by means of a pressed-in stopper (9). This stopper is removed by hand by means of the loop (10), before fluid is removed from the inner container for the first time.

Figure 3A:
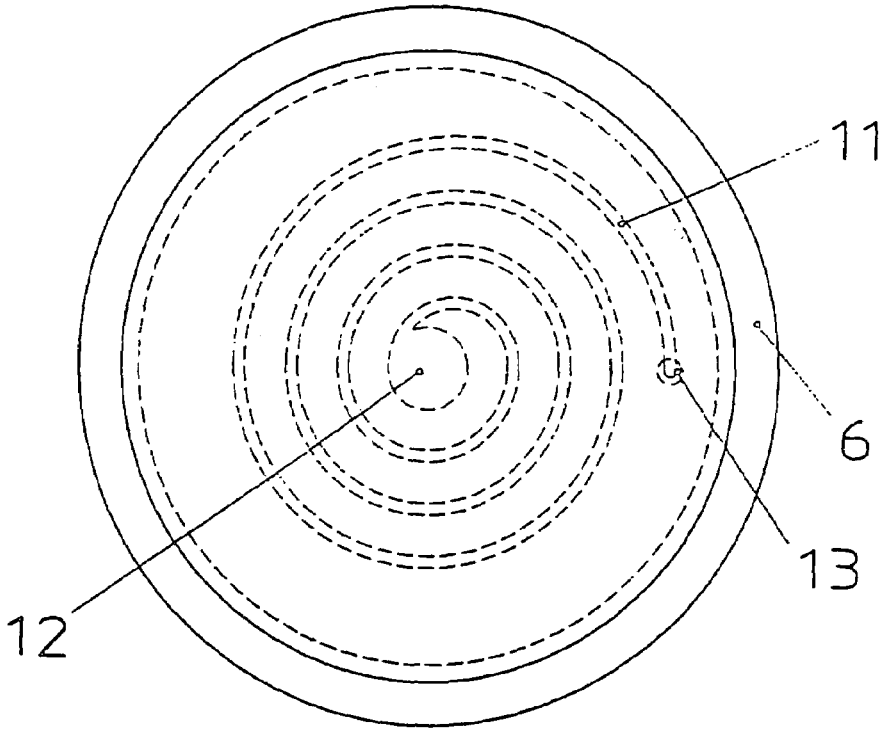
Figure 3B:
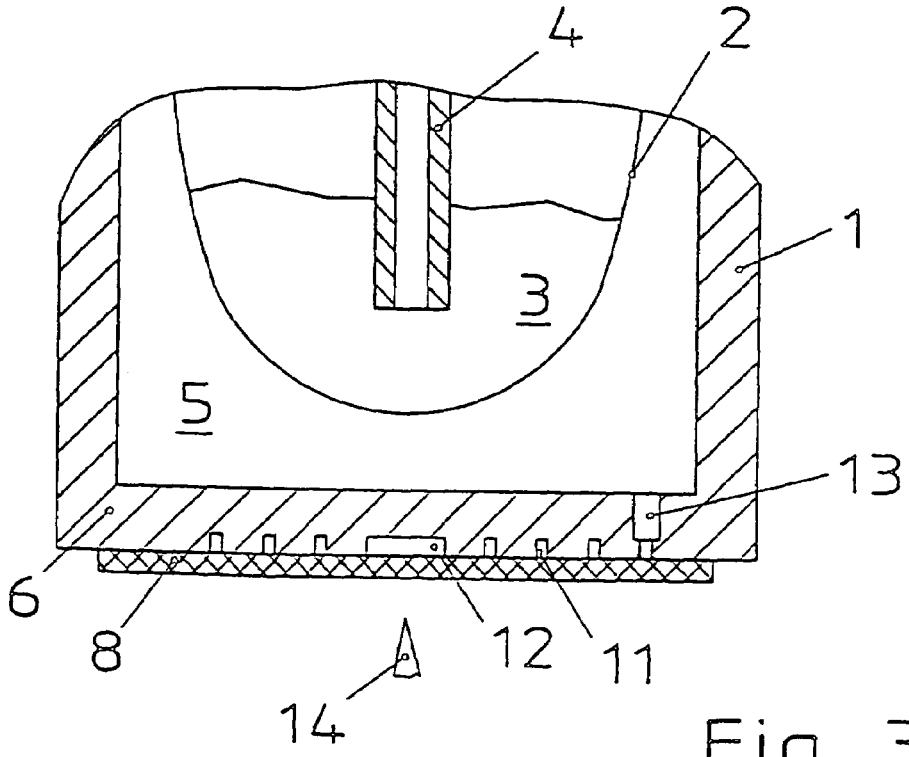

FIG. 3*a* shows a spiral channel (11) with somewhat more than three turns, in the outside of the bottom (6) of the outer container (1). FIG. 3*b* shows a section through this embodiment. The one end of the channel opens into the recess (12); the other end opens into the opening (13). The spiral channel is closed by means of the sealing foil (8) which is pierced by the needle (14) before fluid is removed for the first time.

Figure 4:
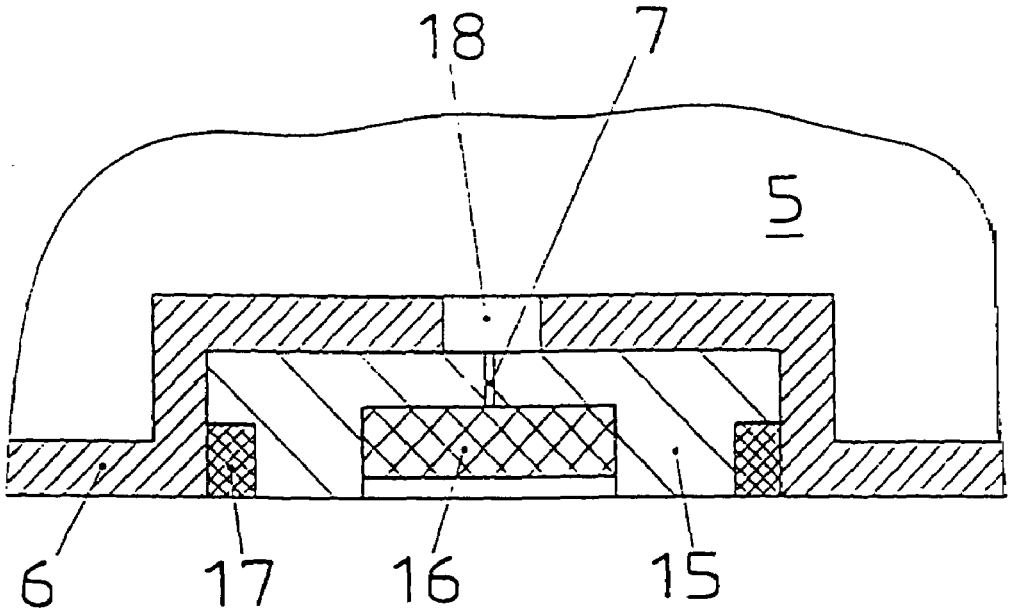

FIG. 4 shows a sectional view through another embodiment of the two-part container. The bottom (6) of the outer container contains a recess in which the insert (15) is disposed which is sealed by means of the annular seal (17) with respect to the wall of the recess. The insert (15) contains the straight channel (7), one end of which opens into the opening (18) in the bottom of the recess. The filter (16) is disposed in front of the other end of the channel (7).

Figure 5:
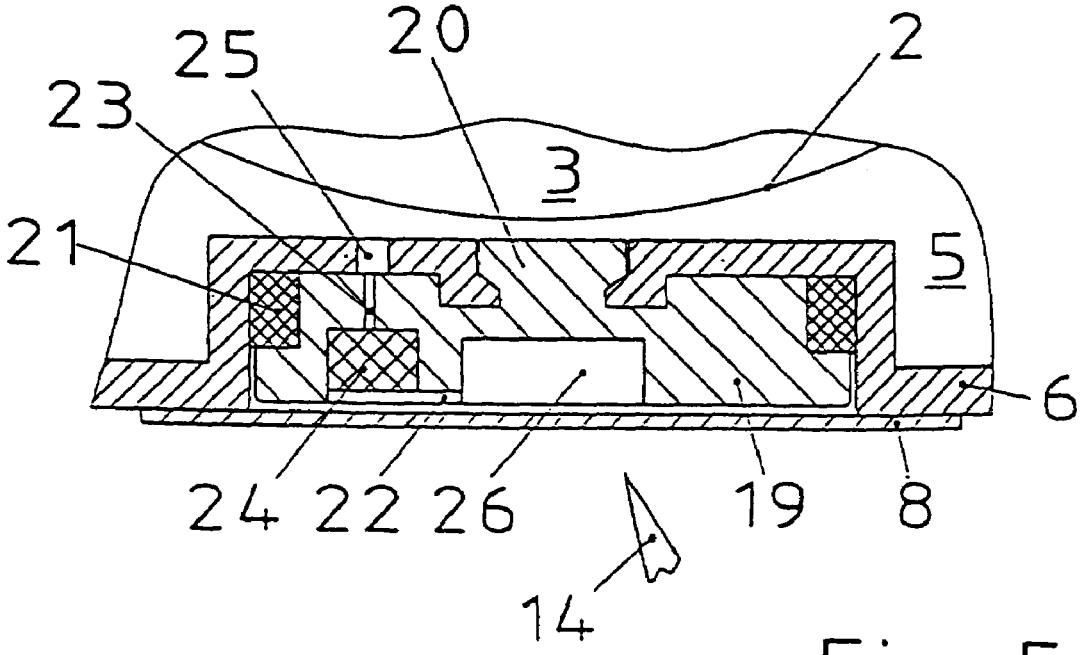

FIG. 5 is a section through another embodiment, wherein the insert (19) is disposed in an inwardly projecting recess in the bottom (6) of the outer container. The insert (19) is fixed in the recess by means of the snap connection (20) and is sealed with respect to the recess by means of the sealing ring (21). The straight channel (23) is arranged outside the central point of the insert (19). Its one end opens into the opening (25) in the bottom of the recess, its other end opens into the opening (25) in the insert (19) in which a filter (24) is arranged. The insert (19) contains a further opening (26). The flange (22) connects the opening (26) to the opening for the filter (24). The insert (19) is covered over by the sealing foil (8) which is pierced by the needle (14) before fluid (3) is removed from the inner container (2) for the first time. When the insert (19) is being pressed into the recess in the bottom (6) of the container, care should be taken to ensure that the insert is in the correct position, so that the opening (25) is disposed in front of the channel (23).

Figure 6:
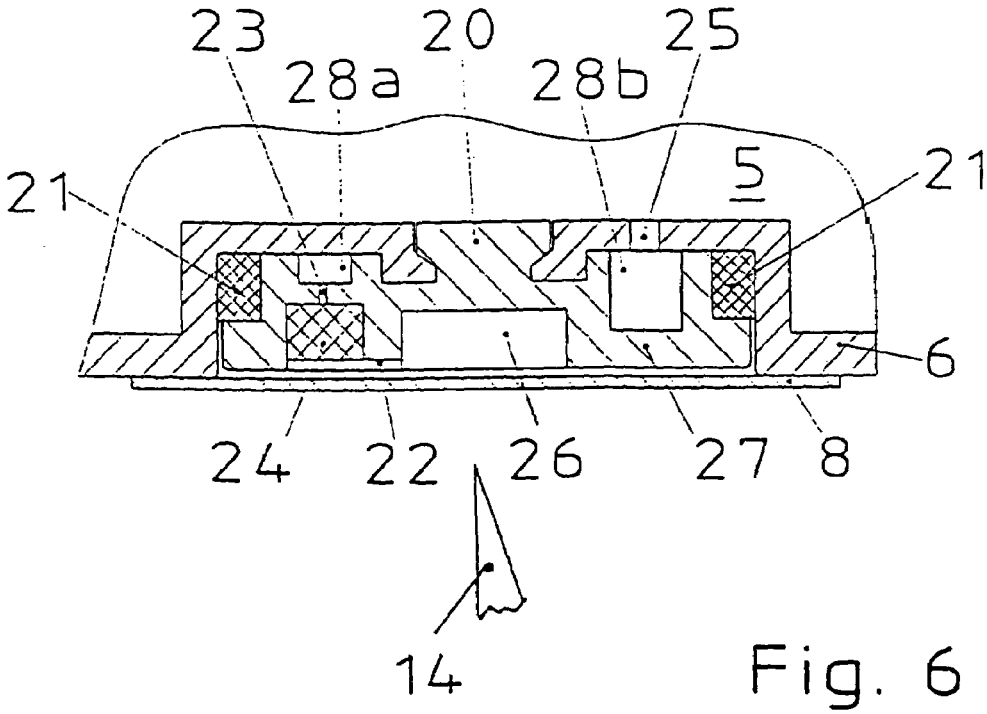

FIG. 6 shows a section through an embodiment where the insert (27) is likewise arranged in an inwardly projecting recess in the container bottom (6). The insert (27) is secured in the recess by means of the snap connection (20), and is sealed with respect to the recess by means of the sealing ring (21). The straight channel (23) opens into the peripheral groove (28*a*; 28*b*) in the insert (27). The peripheral groove can vary in depth. In FIG. 6, it is flatter at the location (28*a*) in the region of the channel (23) than in the remaining part (28*b*). The opening (25) in the bottom of the recess opens in the peripheral groove (28) when the insert (27) is in any azimuthal position.

Figure 7:
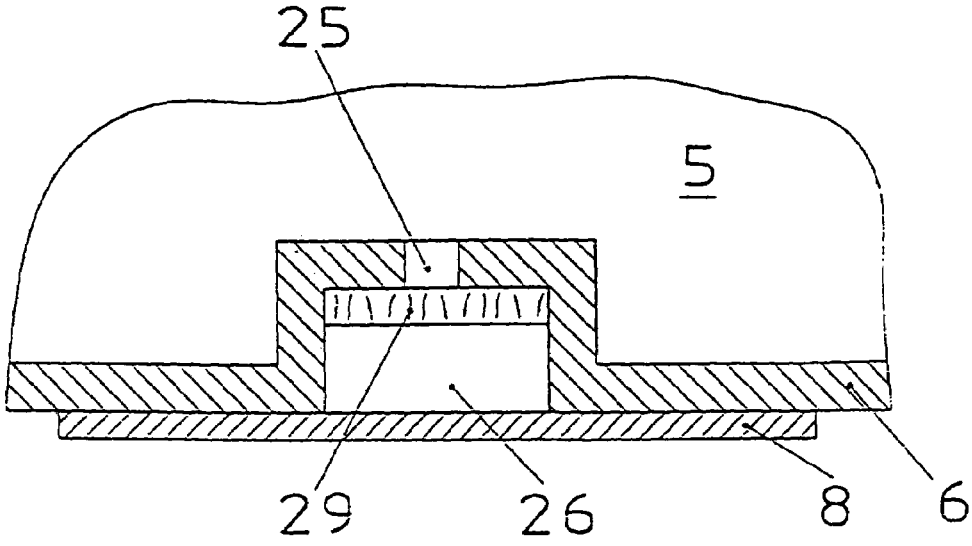

FIG. 7 shows another embodiment in section. A plate (29) of sintered material is pressed into an inwardly inverted recess in the bottom (6) of the outer container. The recess in the bottom contains the opening (25). During the storage time, the bottom of the outer container is covered over by the sealing foil (8) which is pierced or torn away before fluid is removed from the inner container for the first time.

The invention claimed is:

1. In a two-part container where the two-part container consists of an outer container and an inner container and wherein the inner container contains a partially-to fully-volatile fluid, and further wherein the two-part container is disposed in gas-filled surroundings, and wherein the inner container has walls that are impenetrable to diffusion to only a limited extent vis-à-vis the fluid it contains, and is collapsible, and wherein the outer container has walls that are impenetrable to diffusion and which walls are rigid, and wherein the outer container is sealingly connected to the inner container and a gas-filled intermediate space is present between the two containers, the improvement which comprises a pressure compensation device having at least one channel which communicates the gas-filled intermediate space between the outer container and the inner container with the gas-filled surroundings of the two-part container, which channel has a cross-sectional surface area with an equivalent diameter of between 10 μm and 500 μm, and the channel further is in length equal to between five thousand times and one tenth of the equivalent diameter of such channel.

2. The two-part container with pressure compensation device as recited in claim 1 wherein the length of the channel is between one hundred times and one tenth as great as the diameter of said channel.

3. The two-part container with pressure compensative device as recited in claim 2 wherein the length of the channel is between ten times and once as great as the diameter of said channel.

4. The two-part container with pressure compensation device as recited in claim 2 characterised by the channel having a round, approximately square, triangular, or trapezoidal cross-section.

5. The two-part container with pressure compensation device as recited in claim 2 characterised by the channel being straight, or shaped in the form of a meander or a spiral or a screw.

6. The two-part container with pressure compensation device as recited in claim 2, characterised by the channel being arranged on the wall of the outer container, or the channel being arranged in an insert which is arranged on the wall of the outer container and which communicates with an opening in the wall of the outer container.

7. The two-part container with pressure compensation device as recited in claim 2, characterised by the channel having a cross-sectional surface area of less than 1 square millimeter.

8. The two-part container with pressure compensation device as recited in claim 2, characterised by a gas-permeable filter being arranged over one end of the channel.

9. The two-pan container with pressure compensation device as recited in claim 8 characterized by the gas-permeable filter being arranged over the end of the channel which communicates with the gas-filled surroundings.

10. The two-part container with pressure compensation device as recited in claim 2, characterised by a sealing foil closing the end of the channel which communicates with the gas-filled surroundings.

11. The two-pan container with pressure compensation device as recited in claim 2, characterised by the channel being a plurality of channels which communicate the gaseous space between the outer container and the inner container with the gas-filled surroundings of the two-part container, wherein such plurality of channels is present in the form of pores in a plate consisting of an open-pore sintered material, and which pores have a mean pore diameter of between 0.1 micrometers and 150 micrometers with a pore volume of between 1% and 40% of the volume of the sintered body.

12. The two-part container with pressure compensation device as recited in claim 2, characterised by the channel being a plurality of channels which are present in a permeable membrane in the form of a foil, a woven cloth or a fleece.

13. The two-part container with pressure compensation device as recited in claim 12, characterised by the plurality of channels which are present in the permeable membrane consisting of a thermoplastics synthetic material, such as polytetrafluorethylene or polyetheretherketone, or the plurality of channels which are present in the permeable membrane consisting of an elastomer such as silicone or latex.

14. The two-part container with pressure compensation device as recited in claim 12, characterised by the plurality of channels which are present in the permeable membrane in the form of a foil of metal, glass or ceramics, and which are arranged in non-uniform or uniform manner.

15. The two-part container with pressure compensation device as recited in claim 14 wherein the metal foil is made of gold, silicium, nickel or a high quality alloy steel.

16. The two-part container with pressure compensation device as recited in claim 11, characterised by the plurality of channels which are present in the form of pores in the plate consisting of open-pore sintered material, selected from polyethylene, polypropylene, polyvinylidene fluoride, glass, quartz, ceramics or metal.

17. The two-part container with pressure compensation device as recited in claim 2, characterised by the outer container being made of metal.

* * * * *

UNITED STATES PATENT AND TRADEMARK OFFICE

CERTIFICATE OF CORRECTION

PATENT NO. : 7,090,093 B2
APPLICATION NO. : 10/815531
DATED : August 15, 2006
INVENTOR(S) : Dieter Hochrainer et al.

It is certified that error appears in the above-identified patent and that said Letters Patent is hereby corrected as shown below:

Title Page; item (63) and (30);

The foreign priority claim is incorrect. On the cover page of the patent, please amend the related U.S. Application Data at numbered part (63) as shown below.

Continuation of application No. 09/831,054 filed on "Jul. 27, 2001" -- May 4, 2001 --, now abandoned, "which is a continuation of application No. 09/437,275," filed as application No. PCT/EP99/08542 on "Nov. 9, 1999," --Nov. 8, 1999--.

On the cover page of the patent, please amend the Foreign Application Priority Data at numbered part (30) as shown below.

"Nov. 7, 1999" --Nov. 7, 1998-- (DE) ..... 198 51 404--.2--

Please amend the paragraph beginning at column 1, line 4 of the specification as shown below.

"This application is a continuation of Ser. No. 09/437,275, filed on Nov. 10, 1999, U.S. Pat. No. 6,223,933 and which is a continuation of Ser. No. 09/831,054, filed on Jul. 27, 2001, abandoned which is a 371 of PCT/EP99/08542 filed on Nov. 8, 1999." --This application is a continuation of U.S. Patent Application Serial No. 09/831,054, filed May 4, 2001, now abandoned, which is a Section 371 national phase application of PCT/EP99/08542, filed November 8, 1999.--

Signed and Sealed this
Twelfth Day of April, 2011

David J. Kappos

David J. Kappos
*Director of the United States Patent and Trademark Office*